United States Patent [19]

Thomas

[11] 4,336,703

[45] Jun. 29, 1982

[54] TANGENTIAL ROLLING HEAD

[75] Inventor: Diethard Thomas, Schwarzenbek, Fed. Rep. of Germany

[73] Assignee: Wilhelm Fette GmbH, Schwarzenbek, Fed. Rep. of Germany

[21] Appl. No.: 202,054

[22] Filed: Oct. 30, 1980

[30] Foreign Application Priority Data

Nov. 8, 1979 [DE] Fed. Rep. of Germany ..... 2944999

[51] Int. Cl.[3] ..... B21H 3/04

[52] U.S. Cl. ..... 72/104; 72/102; 72/108

[58] Field of Search ..... 72/31, 35, 102, 103, 72/104, 108, 125, 192, 195, 366, 435, 445; 29/111, 112, 115, 116 R

[56] References Cited

U.S. PATENT DOCUMENTS

| | | | |
|---|---|---|---|
| 631,159 | 8/1899 | Echols | 72/104 |
| 1,145,661 | 7/1915 | Bailey | 72/104 |
| 2,204,182 | 6/1940 | Gould | 72/104 |
| 2,476,709 | 11/1951 | Affleck | 72/104 |
| 2,554,166 | 5/1951 | Adcock | 72/104 |
| 2,870,662 | 1/1959 | Poorman | 72/104 |
| 2,909,087 | 10/1959 | Powell | 72/103 |

*Primary Examiner*—Lowell A. Larson
*Attorney, Agent, or Firm*—Michael J. Striker

[57] ABSTRACT

A tangential thread rolling head includes two threaded rollers supported for free rotation on two parallel shafts; each of said rollers is provided with an unbalancing weight which by the force of gravity automatically adjusts a predetermined starting position of the rollers irrespective of the angular position of the head.

14 Claims, 8 Drawing Figures

TANGENTIAL ROLLING HEAD

BACKGROUND OF THE INVENTION

The present invention relates in general to cold forming of screw threads on rotary workpieces, and in particular to a tangential thread rolling head including two threaded rollers arranged opposite each other on supporting means for rotation about parallel axes.

In manufacturing screw threads on a workpiece by means of cold forming processes, the two threaded rollers of the tangential roller head are applied laterally against the periphery of a rotating workpiece so that the rotary motion of the workpiece is transmitted to the threaded rollers which are not positively driven and by applying lateral pressure sufficient for plastic deformation of the material of the workpiece, a thread is rolled in the latter. The pitch of the produced screwthread corresponds, therefore, to the pitch of the thread on the roller surface. A condition for the production of faultless threads, however, is the necessity that courses of the thread on one forming roller engages the screwthread on the workpiece produced by the other roller. This condition can be met only when the courses of threads on both forming rollers or the two forming rollers themselves, be adjusted to a certain predetermined angular position relative to each other both at the beginning of the thread rolling operation and during the rolling process.

In order to meet the aforementioned requirements, in conventional tangential roller heads the two threaded rollers are coupled one to the other by means of synchronizing gears which transmit the rotary movement of one roller to the other roller. The synchronizing gears include a spur gear fixedly mounted on the shaft of each threaded roller and engaging via an idling gear a central main gear so that during the rotation of one threaded roller in one direction the other threaded roller is positively driven in the same rotary direction and with the same rotary speed.

The disadvantage of such prior-art constructions lies in the relatively high manufacturing costs, inasmuch as the transmission gears require the provision of a large number of bearing bores with corresponding bearings for shafts of the gears. In addition, due to the one-sided arrangement of the synchronizing gears, the bearings for the threaded rollers are assymetric so that, due to the high load of the rollers during the rolling process, the shaft of a roller is urged into an oblique position and the formed thread may take a conical shape.

SUMMARY OF THE INVENTION

It is therefore a general object of the present invention to overcome the aforementioned disadvantages.

More particularly, an object of the invention is to provide an improved tangential roller head which is simple in structure and can be manufactured with minimum costs.

Another object of this invention is to provide such an improved roller head in which the width of the roller head holder is reduced and consequently the field of application of the head is increased.

In keeping with these objects, and others which will become apparent hereafter, one feature of the invention resides, in a threaded rolling head for cold forming of screw threads on rotary workpieces, in the provision of two threaded rollers arranged opposite each other on supporting means for free rotation about parallel axes, and unbalancing means provided on respective rollers to rotate the same by the force of gravity into a predetermined starting position.

The unbalancing means together with an independent support of each roller ensure that in any angular position of the roller head the threaded rollers always are automatically adjusted into a predetermined position relative to each other and consequently a faultless formation of the screwthread on the workpiece is always ensured. The tangential roller head need not be applied against the workpiece in a horizontal direction but it can be moved in an arbitrary direction, for instance obliquely, from below or from above, inasmuch as the two rollers, due to the force of gravity, are always promptly rotated into their lower dead center positions irrespective of the angular position of the roller head and its feeding movement.

The unbalance of the threaded rollers can be produced in different ways. According to one feature of this invention, it is possible to arrange an unbalancing weight on a face of each threaded roller, whereby the weight may be integrally incorporated in the body of the roller. In this case, of course, the spacing between the bearings of each roller has to be increased about the width of the unbalancing mass. In another embodiment of this invention, the threaded rollers are supported on rotary shafts, and the unbalancing weight is also fixedly mounted on the shafts, preferably on the outer side of respective fork-like arms formed with bearings for the shafts. In this manner the threaded roller can be arranged symmetrically with respect to its bearings. A symmetrical bearing support can also be attained when one or more recesses or bores are formed in the body of each threaded roller in such a way as to non-uniformly distribute the weight near the periphery of the roller so that the center of gravity be shifted from the axis of rotation as far as possible. Since the position of the center of gravity of the roller relative to its axis of rotation determines the duration of the decreasing swinging movement into the starting position of the roller, it is of advantage when the unbalancing mass or weight extends in radial direction and preferably is extended towards the outer periphery of the rollers.

Moreover, it has been found advantageous when, in order to reduce friction and consequently to create the possibility of using only small or space-saving unbalancing masses, to fix respective threaded rollers on rotary shafts which are supported in roller bearings mounted on fork-like arms of the roller heads or to mount each threaded roller on a roller bearing which rotates on a stationary axle.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
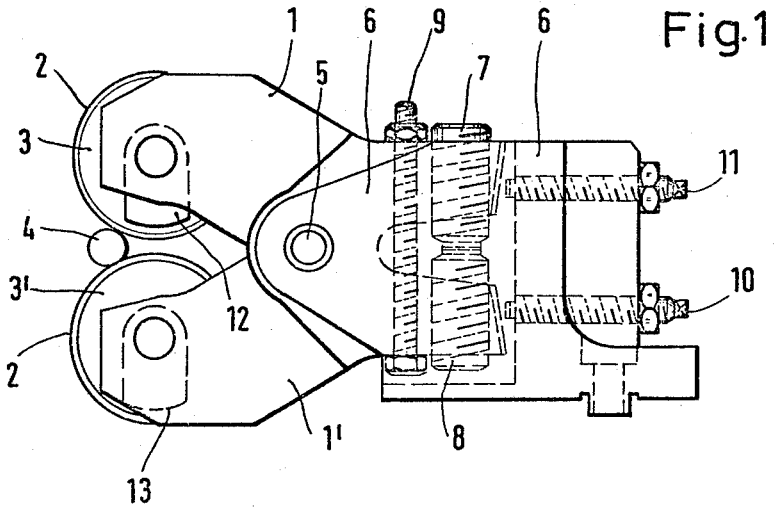
FIG. 1 is a side view of a tangential roller head of this invention.
Figure 2:
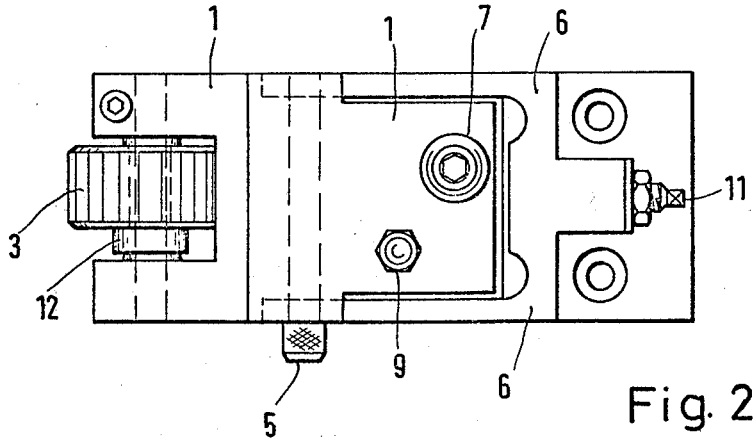
FIG. 2 is a plan view of the roller head of FIG. 1.

The tangential roller head illustrated in FIGS. 1 and 2 is assembled of two roller head arms 1 and 1' each having a fork-shaped front end and being pivotably connected one to the other for movement about a pivot axle 5. Each front fork is provided with an axle or shaft for rotatably supporting rollers 3. The cylindrical surface of each roller is provided with screwthreads 2. The rollers are freely rotatable on the assigned shafts and only by engaging a positively driven rotating workpiece 4 do the rollers 3 and 3' start rotating and by a cold forming process create a screwthread on the workpiece 4.

Both roller head arms 1 and 1', as mentioned above, are rotatable about the pivot axle 5 which is mounted in a roller head holder 6. The radial clearance of the two rollers 3 and 3' is adjustable by means of two setting screws 7 and 8. In order to fix the adjusted spacing between the rollers 3 and 3', there is provided an additional arresting screw 9 by means of which the two setting screws 7 and 8 are firmly held together. The angular position of the roller head arms 1 and 1' relative to the roller head holder 6 is adjustable by setting screws 10 and 11 acting against inclined rear end faces of respective arms. The roller head holder 6 is connected to a sliding carriage of a machine tool.

Each of the threaded rollers 3 and 3' is provided on its side with an unbalancing mass or weight 12 or 13 which by the force of gravity angularly displaces the assigned roller before the start of the rolling process into a predetermined starting position in which the threads 2 on both rollers are in register.

Figure 3:
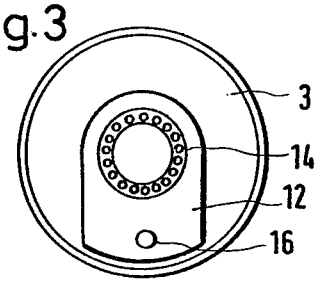
FIG. 3 is a side view of one embodiment of a threaded roller in the roller head of this invention.
Figure 4:
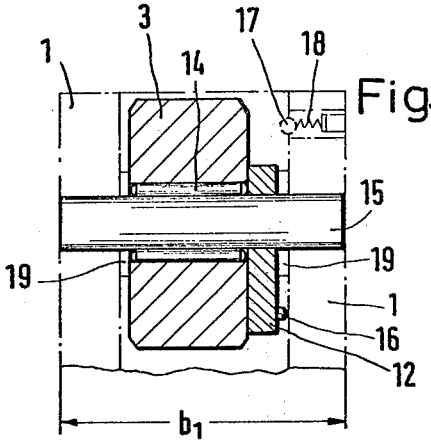
FIG. 4 is an axial section of the roller of FIG. 3.

The construction of the rollers 3 and 3' indicated in FIGS. 1 and 2 is shown in greater detail in FIGS. 3 and 4. To reduce friction during the operation of the roller head, each threaded roller 3 and 3' is provided with needle bearing 14 mounted on fixed axle 15 which in turn is supported in the fork of the assigned roller head arm. In this manner, the roller 3 is freely rotatable about the axle 15. The unbalancing weight 12 which extends radially is provided on its outer surface with a cam 16 which cooperates with a spring-loaded ball 17 arranged together with its biasing spring 18 in a bore of the assigned fork. The ball 17 is located at the upper dead-center point of the roller 3 and prevents the latter from remaining in this undesired upper position. As indicated in FIG. 4, resilient disks, for example of rubber or cup springs of metal, are arranged between the inner wall of the fork and the faces of the roller so as to allow for a small axial displacement of the threaded roller during the operation of the tangential roller head.

Figure 5:
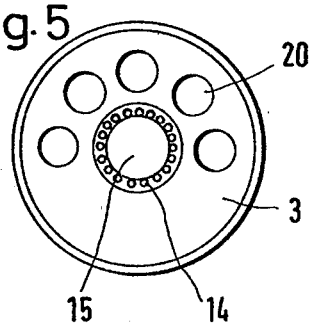
FIG. 5 is a side view of another embodiment of the roller for the head of this invention.
Figure 6:
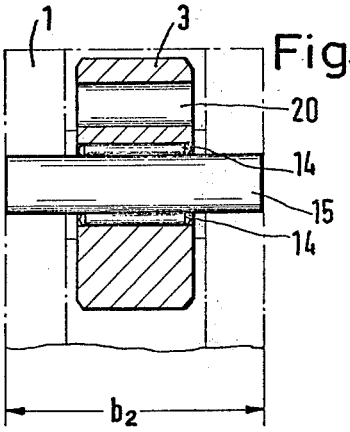
FIG. 6 is an axial section of the roller of FIG. 5.

In the embodiment according to FIGS. 5 and 6, the unbalancing weight of each weight is created by the provision of axial bores 20 distributed along half of its periphery so that the remaining half has a larger mass and consequently, by the effect of the force of gravity, the heavier part always assumes the stable starting position at the lower dead-center point. Also in this modification, the threaded roller 3 is also mounted on a needle bearing 14 supported on a fixed axle 15. The advantage of this embodiment, in comparison with the preceding one, is the symmetrical arrangement of the roller 3 relative to the bearings of the axle 15; by contrast, in the embodiment according to FIGS. 3 and 4, the threaded roller is offset from the plane of symmetry between the bearings of axle 15 about the thickness of the unbalancing weight 12. In addition, the embodiment according to FIG. 5, the width $b_2$ of the fork of the supporting arm is reduced in comparison to the width $b_1$ in the preceding embodiment about the thickness of the unbalancing weight.

Figure 7:
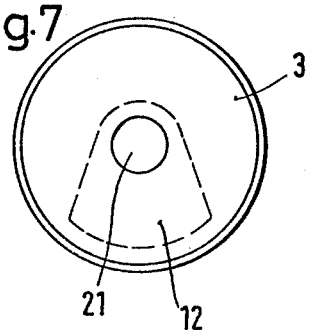
FIG. 7 is still another embodiment of the threaded roller for the rolling head of this invention.
Figure 8:
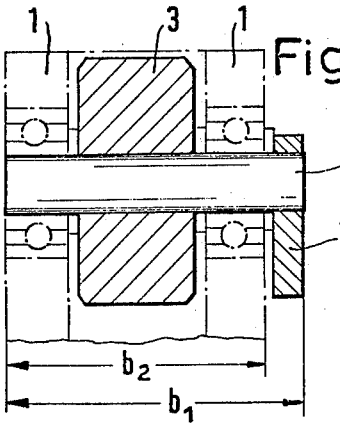
FIG. 8 is an axial section of the roller of FIG. 7.

In the threaded roller according to FIGS. 7 and 8, a shaft 21 is fixedly connected to the roller and is supported for rotation in the fork of the arm 1 in two roller bearings. The shaft 21 supports on its outwardly projecting end portion the unbalancing weight 12 and consequently this embodiment provides for a symmetrical arrangement of the roller 3 with respect to its supporting bearings and has also reduced width $b_2$ of the fork of the supporting arm 1. In this embodiment, the radially directed unbalancing weight 12 is extended toward the periphery of the roller so that its center point is located as close to the periphery as possible, thus assuring a fast return of the roller to its starting or rest position.

It will be understood that each of the elements discussed above, or two or more together, may also find a useful application in other types of constructions differing from the types described above.

While the invention has been illustrated and described as embodied in a specific example of the tangential rolling head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. Tangential roller head for cold forming of screwthreads on rotary workpieces, comprising two threaded rollers arranged opposite each other on supporting means for free rotation about parallel axes, and unbalancing means provided on respective rollers to rotate the same by the force of gravity into a predetermined starting position.

2. A tangential roller head as defined in claim 1, wherein said unbalancing means includes an unbalancing weight secured to an end side of respective unbalancing rollers.

3. A tangential roller head as defined in claim 1, wherein said supporting means include a pair of fork-like arms rotatably connected to each other for movement about a pivot axle, each arm supporting in its fork a shaft for said roller.

4. A tangential roller head as defined in claim 3, wherein said shaft is supported for rotation in said forked arm, said roller being fixed to the rotary shaft, and said unbalancing means being in the form of a weight fixed to an end portion of the rotary shaft to rotate therewith outside the fork of said arm.

5. A tangential roller head as defined in claim 3, wherein said shaft is fixedly connected to said forked arm and said roller being supported for rotation on said shaft, said unbalancing means being in the form of non-uniformly distributed mass near the periphery of respective rollers.

6. A tangential roller head as defined in claim 5, wherein each of said rollers is formed with at least one recess near its peripheral portion to provide for the non-uniform distribution of the roller mass.

7. A tangential roller head as defined in claim 3, wherein each of said roller is supported for rotation on the assigned shaft and said unbalancing means being in the form of radially extending weights connected to one side of the rollers.

8. A tangential roller head as defined in claim 7, wherein said weights expand toward the periphery of the assigned rollers.

9. A tangential roller head as defined in claim 3, wherein each of said rollers is provided with a needle bearing mounted on a fixedly supported shaft.

10. A tangential roller head as defined in claim 9, wherein said roller is symmetrically arranged with respect to the supporting points of said shaft.

11. A tangential roller head as defined in claim 7, wherein the radial weight is provided with a cam and said forked arm includes a spring-biased ball situated in the upper dead-center point of said unbalancing weight and cooperating with said cam to displace the roller from said upper dead-center point.

12. A tangential roller head as defined in claim 3, wherein spring means are arranged on said shaft between the end sides of said roller and said fork-shaped arm.

13. A tangential roller head as defined in claim 3, wherein each of said forked arms is provided with means for setting the clearance between the threaded rollers, and with arresting means for locking the adjusted position of said arms.

14. A tangential roller head as defined in claim 13, wherein the rear end faces of respective arms are inclined, and further including holding means provided with setting screws cooperating with said inclined surfaces to adjust the angular position of said arms with respect to said holding means.

* * * * *